US012662938B2

(12) United States Patent
Atchley et al.

(10) Patent No.: US 12,662,938 B2
(45) Date of Patent: Jun. 23, 2026

(54) TRACER AUTOSAMPLING METHOD

(71) Applicant: NCS MULTISTAGE, LLC, Houston, TX (US)

(72) Inventors: Caleb Atchley, Duncan, OK (US); James David Loyd, Moore, OK (US); Corey Waller, Yukon, OK (US)

(73) Assignee: NCS MULTISTAGE, LLC, Houston, TX (US)

( * ) Notice: Subject to any disclaimer, the term of this patent is extended or adjusted under 35 U.S.C. 154(b) by 0 days.

(21) Appl. No.: 18/845,745

(22) PCT Filed: Jun. 21, 2023

(86) PCT No.: PCT/US2023/068776

§ 371 (c)(1),
(2) Date: Sep. 10, 2024

(87) PCT Pub. No.: WO2023/250349

PCT Pub. Date: Dec. 28, 2023

(65) Prior Publication Data

US 2024/0426213 A1 Dec. 26, 2024

Related U.S. Application Data

(60) Provisional application No. 63/354,060, filed on Jun. 21, 2022.

(51) Int. Cl.
*E21B 49/08* (2006.01)

(52) U.S. Cl.
CPC ..... *E21B 49/086* (2013.01); *E21B 49/0875* (2020.05); *E21B 49/088* (2013.01)

(58) Field of Classification Search
CPC .. E21B 49/086; E21B 49/0875; E21B 49/088; E21B 49/087; E21B 49/08
See application file for complete search history.

(56) References Cited

U.S. PATENT DOCUMENTS 4,454,772 A * 6/1984 Brunner ..... G01N 1/10 73/863.31
9,926,782 B2 3/2018 Walker
(Continued)

FOREIGN PATENT DOCUMENTS

CA 2712746 2/2011
WO WO 2020/142082 7/2020
(Continued)

OTHER PUBLICATIONS

Invitation to Pay Additional Fees for International (PCT) Patent Application No. PCT/US2023/068776, dated Sep. 8, 2023, 3 pages.
(Continued)

*Primary Examiner* — Kristyn A Hall
(74) *Attorney, Agent, or Firm* — Sheridan Ross P.C.

(57) ABSTRACT

Systems and methods for collecting samples of production fluid from a wellbore are disclosed. In one example, a method for collecting samples of production fluid from a wellbore includes providing a fluid collector configured to selectively divert production fluid from a production flow line downstream of the wellbore to at least one sample container, and a controller configured to communicate with a computing device located remote from the fluid collector, and instructing the fluid collector to divert samples of production fluid to the at least one sample container according to a first sample collection schedule. The method also includes, during the first sample collection schedule, instructing the fluid collector, via the computing device located remote from the fluid collector, to divert samples of production fluid to the at least one sample container according to a second sample collection schedule.

20 Claims, 10 Drawing Sheets

(56) References Cited

U.S. PATENT DOCUMENTS

| | | | | |
|---|---|---|---|---|
| 10,465,502 | B2 | 11/2019 | El-Khazindar et al. | |
| 11,118,452 | B1 * | 9/2021 | Yateem | E21B 47/12 |
| 2014/0260694 | A1 | 9/2014 | Szlendak | |
| 2017/0139078 | A1 | 5/2017 | Knight et al. | |
| 2022/0018816 | A1 | 1/2022 | Azizi et al. | |

FOREIGN PATENT DOCUMENTS

| | | |
|---|---|---|
| WO | WO 2021/081144 | 4/2021 |
| WO | WO 2023/250349 | 12/2023 |

OTHER PUBLICATIONS

International Search Report and Written Opinion for International (PCT) Patent Application No. PCT/US2023/068776, dated Nov. 16, 2023, 17 pages.

* cited by examiner

TRACER AUTOSAMPLING METHOD

CROSS REFERENCE TO RELATED APPLICATIONS

This application is a national stage application under 35 U.S.C. 371 and claims the benefit of PCT Application No. PCT/US2023/068776 having an international filing date of 21 Jun. 2023, which designated the United States, and which PCT application claimed the benefit of U.S. Provisional Application No. 63/354,060 filed 21 Jun. 2022, the contents of each of which are incorporated herein by reference in their entireties.

TECHNICAL FIELD

The technical field generally relates to collecting samples of fluid, and more specifically to collecting samples of production fluid from a wellbore over a multi-day interval.

BACKGROUND

During the production phase of a wellbore, it may be desirable to collect samples of production fluid. For example, in wells that have been subjected to hydraulic fracturing, an operator may inject one or more tracer chemicals into the formation adjacent the wellbore and monitor production fluid extracted from the wellbore to assess the quality and or quantity of the fractures within the formation.

In situations where production fluid is sampled over a relatively long period of time (e.g., over a number of hours, or a number of days), automated sample collection systems have been used. In these systems, typically an operator initiates a collection schedule for the collection system while at the well site and returns to the well site after the pre-programmed schedule has concluded to pick up the samples. The samples may then be sent to a laboratory for analysis.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

This disclosure is related to an automated and remote-operable wellsite fluid sample collection system and method. Such a system and method may be used for tracer analysis, or other analyses that require periodic collection of production fluid from a wellsite.

In accordance with one aspect, there is provided a method for collecting samples of production fluid from a wellbore, the method comprising: providing a fluid collector configured to selectively divert production fluid from a production flow line downstream of the wellbore to at least one sample container, and a controller comprising a processor, a memory, and a communication module configured to communicate with a computing device located remote from the fluid collector; instructing the fluid collector to divert samples of production fluid to the at least one sample container according to a first sample collection schedule; and during the first sample collection schedule, instructing the fluid collector, via the computing device located remote from the fluid collector, to divert samples of production fluid to the at least one sample container according to a second sample collection schedule, the second sample collection schedule being different than the first collection schedule.

In some embodiments, the method further comprises: monitoring one or more sensors to collect data associated with at least one of: a location of the fluid collector; a pressure of the production fluid; a flow rate of the production fluid; a pressure of a pneumatic actuation system associated with the fluid collector; an ambient temperature; and a level of a power supply configured to supply electrical power to the controller; and transmitting at least a portion of the collected data to the computing device located remote from the fluid collector.

In some embodiments, the monitoring is performed at least every 60 minutes, preferably at least every 30 minutes, and more preferably at least every 15 minutes.

In some embodiments, the second sample collection schedule is determined in response to data transmitted to the computing device located remote from the fluid collector.

In some embodiments, the collected data comprises data associated with a pressure of the production fluid, and wherein in response to determining that the pressure of the production fluid has increased or decreased by a predetermined percentage, the second sample collection schedule comprises diverting a sample of production fluid to the at least one sample container within a predetermined time of determining the increase or decrease in production fluid pressure.

In some embodiments, the collected data comprises data associated with the flow rate of the production fluid, and wherein in response to determining that the flow rate of the production fluid has increased or decreased by a predetermined percentage, the second sample collection schedule comprises diverting a sample of production fluid to the at least one sample container within a predetermined time of determining the increase or decrease in production fluid flow rate.

In some embodiments, the predetermined percentage is between about 5% and about 25%, and preferably about 10%.

In some embodiments, the predetermined time is about 2 minutes to about 30 minutes, and preferably about 5 minutes.

In some embodiments, the first sample collection schedule comprises diverting samples of production fluid to the at least one sample container more frequently than the second sample collection schedule.

In some embodiments, the first sample collection schedule comprises diverting a first volume of production fluid to the at least one sample container and the second sample collection schedule comprises diverting a second volume of production fluid to the at least one sample container.

In some embodiments, the first volume is greater than the second volume.

In some embodiments, the method further comprises, after instructing the fluid collector to divert samples of production fluid to the at least one sample container according to a second sample collection schedule: instructing the fluid collector, via the computing device located remote from the fluid collector, to divert samples of production fluid to the at least one sample container according to a third sample collection schedule, the third sample collection schedule being different than the second collection schedule.

In some embodiments, the instructing the fluid collector to divert samples of production fluid to the at least one sample container according to a first sample collection schedule is performed at the fluid collector.

In accordance with another broad aspect, there is provided a method of collecting samples of production fluid from a wellbore, the method comprising: providing a fluid collector configured to selectively divert production fluid from a production flow line downstream of the wellbore to at least one sample container, and a controller comprising a processor, a memory, and a communication module configured to communicate with a computing device; instructing the fluid collector to divert samples of production fluid to the at least one sample container according to a sample collection schedule; monitoring one or more sensors to collect data associated with at least one of: a location of the fluid collector; a pressure of the production fluid; a flow rate of the production fluid; a pressure of a pneumatic actuation system associated with the fluid collector; an ambient temperature; and a level of a power supply configured to supply electrical power to the controller; and transmitting at least a portion of the collected data to the computing device; wherein the controller is configured to change the sample collection schedule in response to the data transmitted.

In accordance with another broad aspect, there is provided a method of collecting samples of production fluid from a wellbore, the method comprising: providing a fluid collector configured to selectively divert production fluid from a production flow line downstream of the wellbore to at least one sample container, and a controller comprising a processor, a memory, and a communication module configured to communicate with a computing device; instructing the fluid collector to divert samples of production fluid to the at least one sample container according to a first sample collection schedule; monitoring one or more sensors to collect data associated with at least one of: a location of the fluid collector; a pressure of the production fluid; a flow rate of the production fluid; a pressure of a pneumatic actuation system associated with the fluid collector; an ambient temperature; and a level of a power supply configured to supply electrical power to the controller; and instructing the fluid collector to divert samples of production fluid to the at least one sample container according to a second sample collection schedule in response to the data transmitted.

In accordance with another broad aspect, there is provided a method for collecting samples of production fluid from a wellbore, the method comprising: providing a fluid collector configured to selectively divert production fluid from a production flow line downstream of the wellbore to at least one sample container, and a controller comprising a processor, a memory, and a communication module configured to communicate with a computing device located remote from the fluid collector; instructing the fluid collector to divert samples of production fluid to the at least one sample container according to a first sample collection schedule; monitoring one or more sensors to collect data associated with a pressure and/or a flow rate of the production fluid; and in response to determining that the pressure and/or the flow rate of the production fluid has increased or decreased by a predetermined percentage, instructing the fluid collector to divert samples of production fluid to the at least one sample container according to a second sample collection schedule.

In accordance with another broad aspect, there is provided a system for collecting samples of production fluid from a wellbore, the system comprising: a fluid collector configured to selectively divert production fluid from the wellbore to at least one sample container; and a controller comprising a processor, a memory, and a communication module configured to communicate with a computing device located remote from the fluid collector; wherein the controller is configured to instruct the fluid collector to divert samples of production fluid to the at least one sample container according to a first sample collection schedule, and wherein, in response to instructions from the computing device located remote from the fluid collector, the controller is configured to instruct the fluid collector to divert samples of production fluid to the at least one sample container according to a second sample collection schedule, the second sample collection schedule being different than the first collection schedule.

In some embodiments, the predetermined percentage is between about 5% and about 25%, and preferably about 10%.

In some embodiments, the predetermined time is about 2 minutes to about 30 minutes, and preferably about 5 minutes.

In some embodiments, the first sample collection schedule comprises diverting samples of production fluid to the at least one sample container more frequently than the second sample collection schedule.

In some embodiments, the first sample collection schedule comprises diverting a first volume of production fluid to the at least one sample container and the second sample collection schedule comprises diverting a second volume of production fluid to the at least one sample container.

In some embodiments, the first volume is greater than the second volume.

In some embodiments, the method further comprises, after instructing the fluid collector to divert samples of production fluid to the at least one sample container according to the second sample collection schedule: instructing the fluid collector, via the computing device located remote from the fluid collector, to divert samples of production fluid to the at least one sample container according to a third sample collection schedule, the third sample collection schedule being different than the second collection schedule.

In some embodiments, the instructing the fluid collector to divert samples of production fluid to the at least one sample container according to the first sample collection schedule is performed at the fluid collector.

In some embodiments, the method further comprises the controller changing the sample collection schedule by instructing the fluid collector to divert samples of production fluid to the at least one sample container according to a subsequent sample collection schedule.

In some embodiments, the sample collection schedule comprises diverting samples of production fluid to the at least one sample container more frequently than the subsequent sample collection schedule.

In some embodiments, the sample collection schedule comprises diverting a first volume of production fluid to the at least one sample container and the subsequent sample collection schedule comprises diverting a second volume of production fluid to the at least one sample container.

In some embodiments, the first volume is greater than the second volume.

In some embodiments, the monitoring is performed at least every 60 minutes, preferably at least every 30 minutes, and more preferably at least every 15 minutes.

In some embodiments, the system further comprises: a position sensor configured to collect data associated with a location of the fluid collector, wherein the communication module is configured to transmit data collected by the position sensor to the computing device located remote from the fluid collector.

In some embodiments, the system further comprises: a fluid sensor configured to collect data associated with at least one of a pressure and a flow rate of the production fluid, wherein the communication module is configured to transmit data collected by the fluid sensor to the computing device located remote from the fluid collector.

In some embodiments, the at least one sample container comprises two or more sample containers, and wherein the fluid collector comprises a carousel for sequentially advancing each of the two or more sample containers into a sample collecting position.

In some embodiments, the fluid collector comprises a pneumatic actuator for advancing the carousel and a vessel in fluid communication with the pneumatic actuator for storing pressurized gas.

In some embodiments, the system further comprises: a pressure sensor configured to collect data associated with a pressure of the vessel, wherein the communication module is configured to transmit data collected by the pressure sensor to the computing device located remote from the fluid collector.

In some embodiments, the system further comprises: a power supply configured to supply electrical power to the controller.

In some embodiments, the power supply comprises a photovoltaic charging system.

In some embodiments, the fluid collector is mounted within a first housing, and the controller is mounted within a second housing.

In some embodiments, the second housing is compliant with the National Electrical Manufacturers Association (NEMA) IP66 standard.

It will be appreciated by a person skilled in the art that a system or method disclosed herein may embody any one or more of the features contained herein and that the features may be used in any particular combination or sub-combination.

BRIEF DESCRIPTION OF THE DRAWINGS

For a better understanding of the described embodiments and to show more clearly how they may be carried into effect, reference will now be made, by way of example, to the accompanying drawings in which.

The drawings included herewith are for illustrating various examples of apparatus and methods of the teaching of the present specification and are not intended to limit the scope of what is taught in any way.

DETAILED DESCRIPTION

Techniques described herein relate to systems and methods for sampling production fluid from a wellbore.

Several alternative implementations and examples have been described and illustrated herein. The implementations of the technology described above are intended to be exemplary only. A person of ordinary skill in the art would appreciate the features of the individual implementations, and the possible combinations and variations of the components. A person of ordinary skill in the art would further appreciate that any of the implementations could be provided in any combination with the other implementations disclosed herein. It is understood that the technology may be embodied in other specific forms without departing from the central characteristics thereof. The present implementations and examples, therefore, are to be considered in all respects as illustrative and not restrictive, and the technology is not to be limited to the details given herein. Accordingly, while the specific implementations have been illustrated and described, numerous modifications come to mind.

Figure 1:
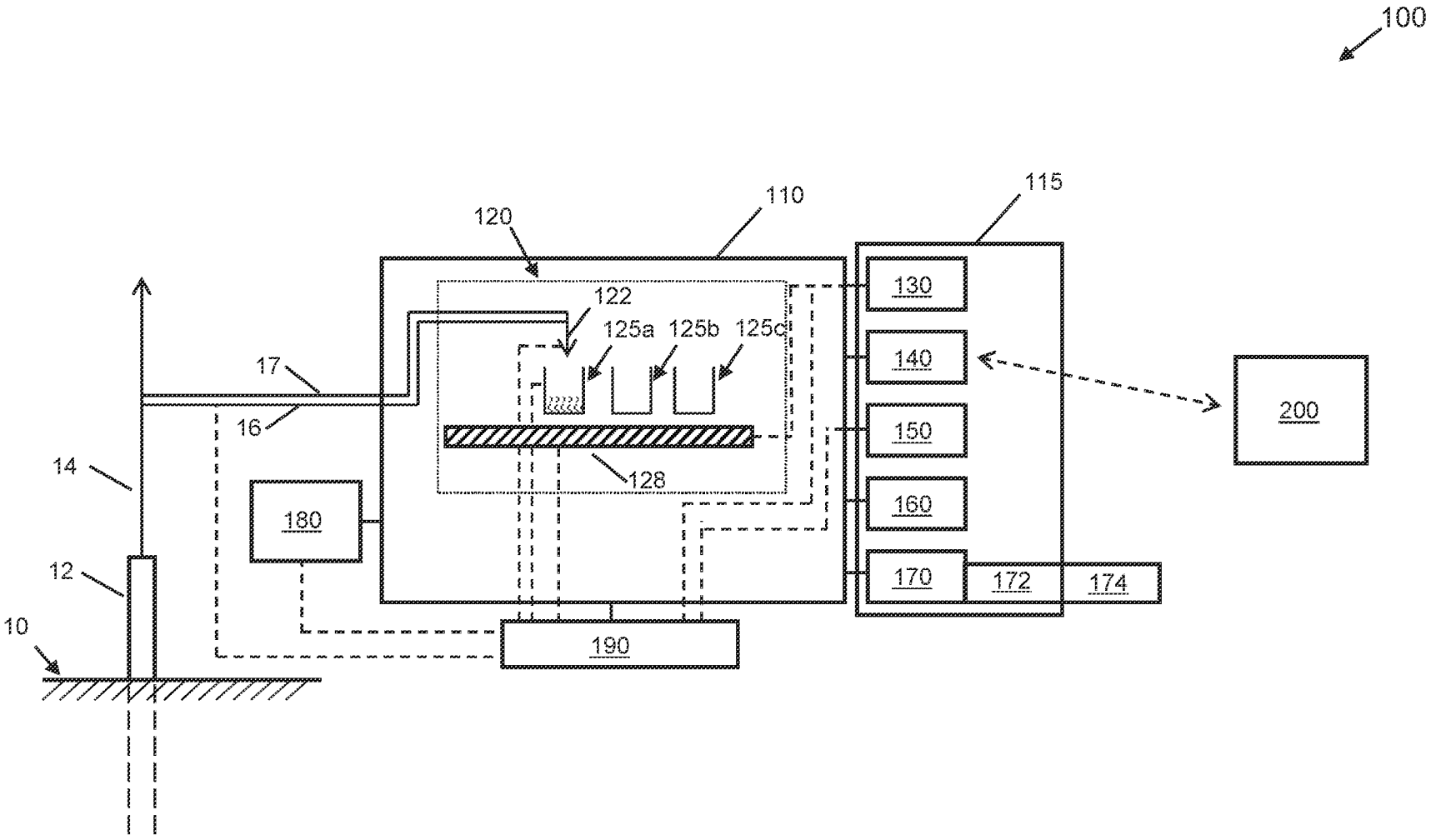
FIG. 1 is a schematic diagram of system for collecting samples of production fluid from a wellbore, in accordance with one embodiment.

FIG. 1 illustrates an example of a system 100 for collecting samples of production fluid from a wellbore. In the illustrated example, a fluid collector 120 is provided within a housing or cabinet 110. The fluid collector 120 is connected to a production flow line 14 that conveys production fluid 15 from a wellhead 12 of a wellbore that extends below a ground surface 10. It will be appreciated that the fluid collector 120 may be connected to a production flow line 14 at any point between the wellhead and a junction where the production flow line 14 joins up with another flow line (e.g., before entering at a separator). In some alternative implementations, the fluid collector 120 can be in fluid communication with a production fluid line at surface that is downstream of a separator, for example if the production fluid is first subjected to a separation stage (e.g., degassing) and then the resulting fluid is to be sampled and analyzed.

Figure 2:
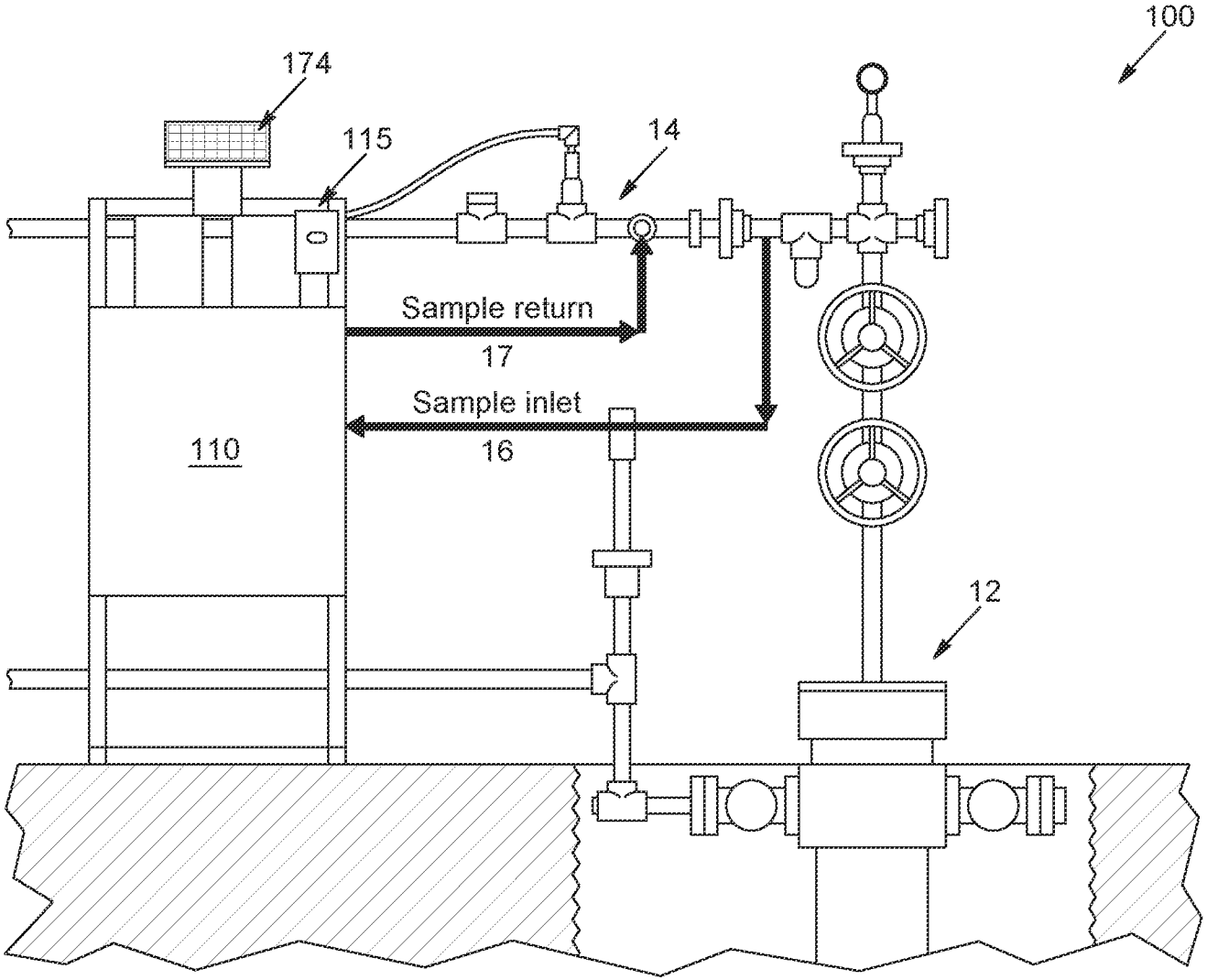
FIG. 2 shows an example system for collecting samples of production fluid from a wellbore installed at a wellbore site.

As shown in FIG. 2, the fluid collector 120 is connected to the production flow line 14 through a sample inlet line 16 and a sample return line 17. In some embodiments, the fluid collector 120 may be connected to the production flow line 14 by a connector, such as a ½" National pipe taper ("NPT")-bore thru fitting, and a conduit line (i.e., the sample inlet line 16). Upstream of the connector, a pressure controlled 3-way valve and ball valve may be used for pressure isolation when installing the fluid collector 120 and/or the cabinet 110. These valves can also be used to take samples from the production flow line 14. If a 3-way valve is used, it may flow towards (and be connected to) a process in port (i.e., the port of entry for the sample inlet line 16) on the cabinet 110.

In the illustrated example, the fluid collector 120 may be connected back to the production flow line 14 from the cabinet 110 by a sample return line 17. In some embodiments, the sample return line 17 can be a ¼" conduit line. The sample return line 17 can be coupled to a pressure controlled 3-way valve, to a ¼" check valve followed by a ½" NPT-bore thru fitting. Optionally, an additional ball valve may be attached to the ½" fitting on the production flow line 14 allowing for isolation when the fluid collector 120 and/or the cabinet 110 is removed.

Preferably, the cabinet 110 is positioned within a distance of the inlet connection to the production flow line 14. For example, the cabinet 110 can be about 6 feet from the production flow line 14 or within a distance of about 2 to 10 feet.

The fluid collector 120 is configured to selectively divert production fluid 15 from the wellbore to a sample container 125. Each such diversion may be characterized as collecting a sample of production fluid 15.

In the illustrated example, the fluid collector 120 includes a purge gas-powered flow through accumulator 122 with fixed volume cylinder(s) 123, and a bottle carousel 128 for bringing one of multiple sample containers 125 into position relative to the accumulator 122. The accumulator 122 dispenses samples of production fluid 15 into a sample container 125. The bottle carousel 128 may then rotate, allowing a new sample container 125 to receive one or more samples of production fluid 15.

In the illustrated example shown in FIG. 1, the bottle carousel 128 is configured to receive three sample containers 125*a*, 125*b*, and 125*c*. In some embodiments, the bottle carousel 128 may be configured to receive any number of sample containers 125, such as up to eight (8), ten (10), twelve (12), etc. sample containers 125. In some embodiments, the sample containers 125 may be sample bottles made from glass and/or High-density polyethylene (HDPE), such as those available from NCS Multistage of Houston, Texas. The sample containers 125 can have any size for containing a sample of the production fluid 15. For example, without limitation, the sample containers 125 can be anywhere from 10 mL to 1 L, or between 50 mL and 250 mL. In the exemplary embodiment, the sample containers 125 are about 100 mL.

In the illustrated example, the instrumentation is powered by nitrogen as the purge gas 19, but other suitable gases, such as inert gases, may alternatively be used. In the illustrated example, a pressure vessel 180 is provided to store a supply of purge gas for powering the fluid collector 120. In some embodiments, the pressure vessel 180 (e.g., a pressurized cylinder) may be connected to the cabinet 110 using a regulator and a hose (not shown). The regulator may ensure that only a specified pressure is used for operation of the instrumentation. For example, the regulator can maintain the pressure from between about 1 and about 100 psi or about 5 to about 75 psi. In some embodiments, the regulator ensures the pressure of the pressure vessel 180 is between about 10 and about 50 psi, or about 40 psi [0.3 MPa].

In some embodiments, such as when the sample sizes include a high oil content, foaming or frothing can occur, which can increase the risk of leaks in the sample containers. Such foaming or frothing can be reduced or eliminated by reducing the pressure of the purge valve and increasing the purge time. In some embodiments, a sensor can be used to determined whether foaming or frothing is occurring or likely to occur in the samples, and a controller of the system 100 can be configured to automatically adjust the pressure of the purge valve and/or the purge time to adjust for the frothing. For example, the system 100 can be set to purge the production fluid 15 into the sample container 125 at a pressure of about 40 psi. If the sensor determines that foaming or froth is occurring, the controller can adjust the regulator to maintain the pressure at the purge valve (such as the second 3-way valve 21*b* shown in FIGS. 3 to 6) to 20 psi. This process can be repeated until the foaming or frothing discontinues in the sample container 125.

Figure 3:
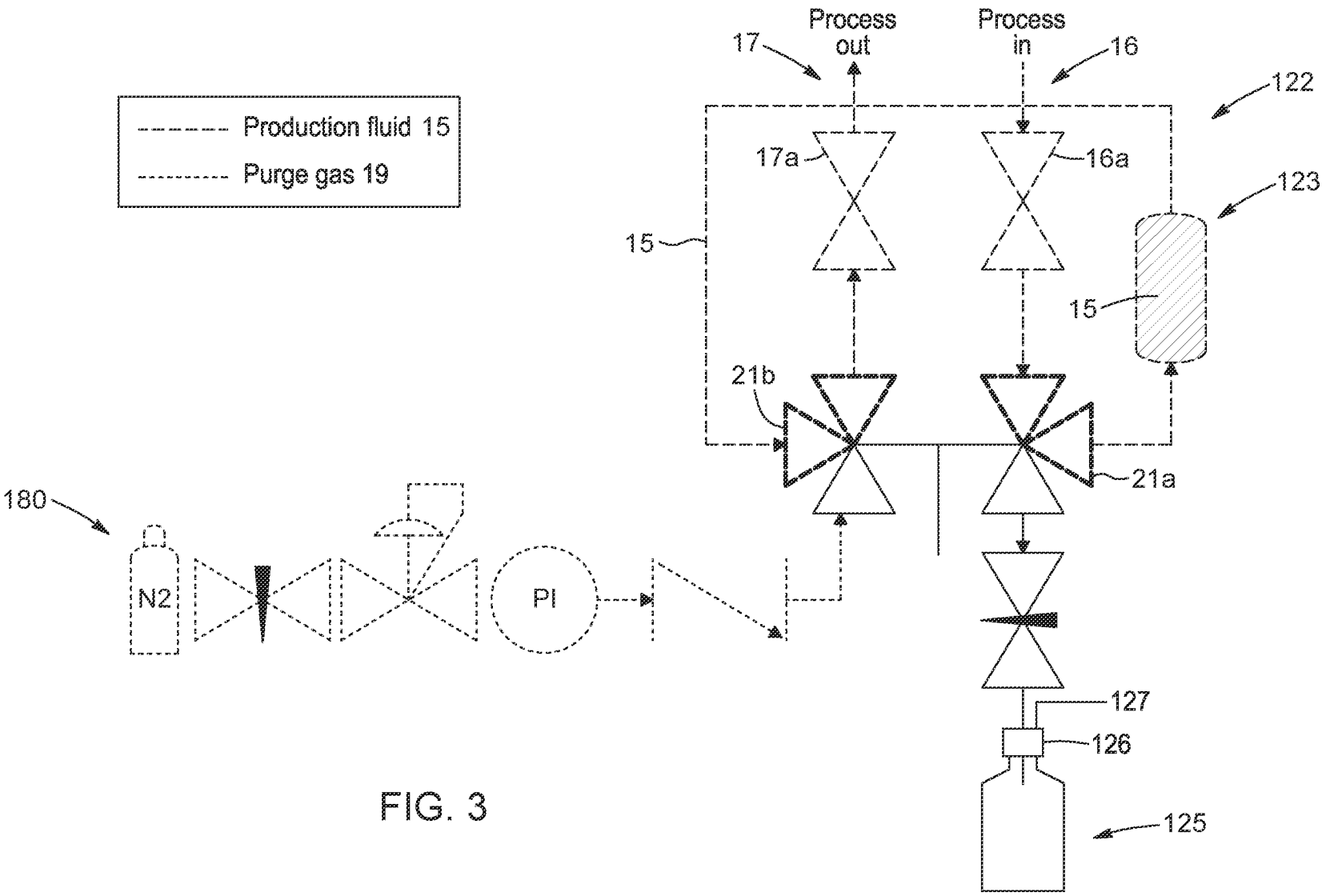
FIG. 3 is a schematic flow diagram for a fluid collector, illustrating a first step.
Figure 4:
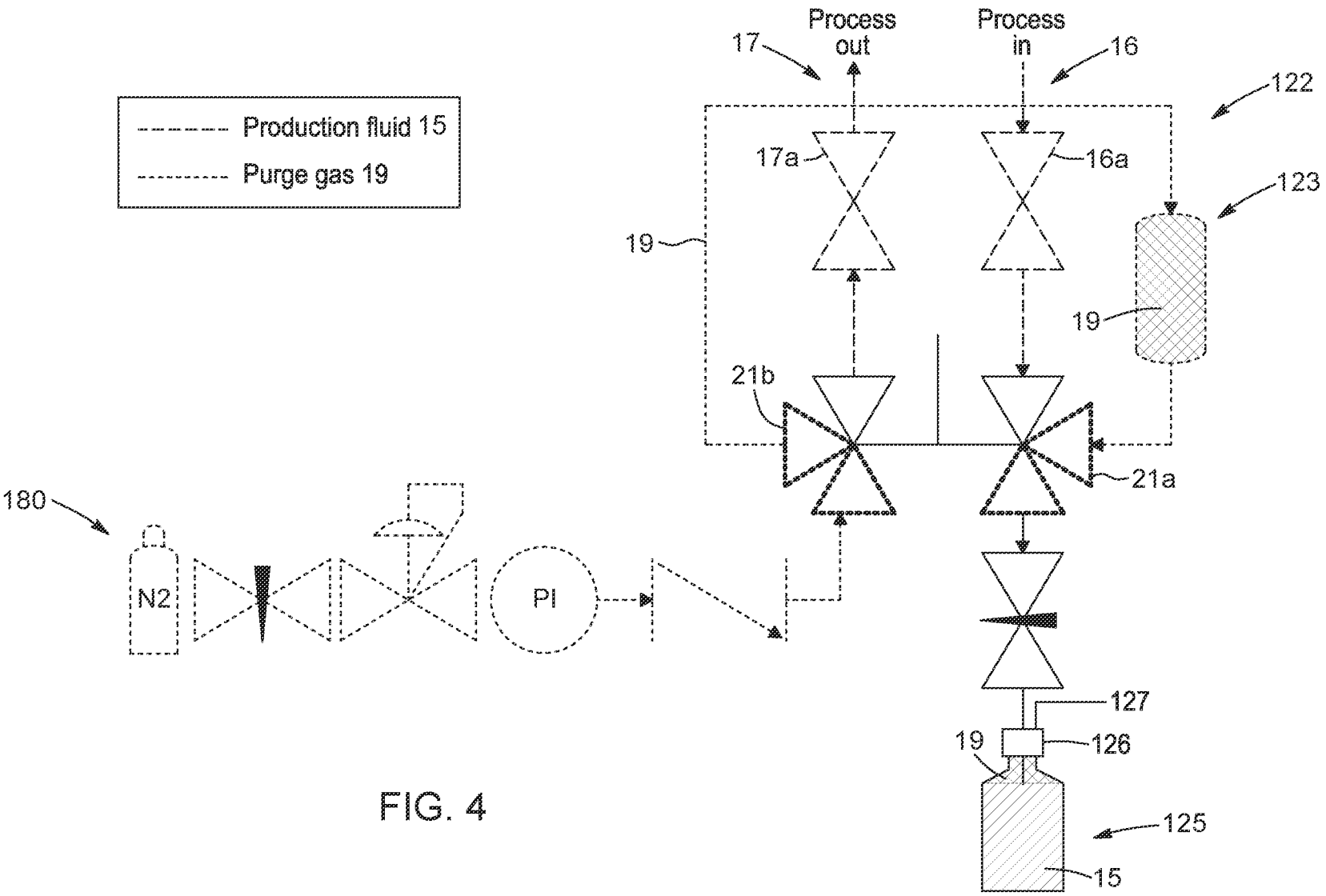
FIG. 4 is a schematic flow diagram for the fluid collector of FIG. 3, illustrating a second step.

FIGS. 3 and 4 illustrate a process flow for collecting a sample of production fluid 15 using a fluid collector 120 with a single fixed-volume sampling cylinder 123. The fluid collector 120 includes an accumulator 122 having the sample inlet line 16, a sample inlet valve 16*a*, the sample return line 17, and a sample return valve 17*b*. The accumulator 122 further includes a first 3-way valve 21*a*, which provides fluid communication between a cylinder 123, the sample inlet line 16, and the sample container 125, and a second 3-way valve 21*b*, which provides fluid communication between pressure vessel 180, the cylinder 123, and the sample return line 17.

As can be seen in FIG. 3, the first 3-way valve 21*a* provides fluid communication between the cylinder 123 and the sample inlet line 16 and the second 3-way valve 21*b* provides fluid communication between the cylinder 123 and the sample return line 17, such that production fluid 15 is flowing in through the sample inlet line 16, through the cylinder 123, and back to the production flow line 14 through the sample return line 17. During this first stage, the first 3-way valve 21*a* is closed to the sample container 125 and the second 3-way valve 21*b* is closed to the pressure vessel 180, such that access to purge gas 19 is closed. In this embodiment, the purge gas 19 is nitrogen gas ($N_2$).

As can be seen in FIG. 4, the first 3-way valve 21*a* provides fluid communication between the cylinder 123 and the sample container 125 and the second 3-way valve 21*b* provides fluid communication between the cylinder 123 and the pressure vessel 180, such that the purge gas 19 displaces the production fluid 15 from the cylinder 123 into the sample container 125. The flow of production fluid 15 through the accumulator 122 is stopped during this period. In some embodiments, the cylinder 123 may have a pressure rating of at least 1,800 psi.

The cylinder 123 can have any size that is suitable as a sample. For example, the cylinder 123 can have a volume of between about 10 mL and about 1000 mL, or about 50 mL to 250 mL. In some embodiments, the cylinder 123 may have a volume of 100 mL, allowing 100 mL samples of production fluid to be collected. Consideration should be given to the space the cylinder 123 will occupy within the cabinet 110 as well as the purge gas 19 capacity for the resulting sample when determining the size of the cylinder 123. It will be appreciated that the accumulator 122 may have two or more fixed volume cylinders of similar or different sizes, which may facilitate the collection of different sized samples of production fluid 15.

Figure 5:
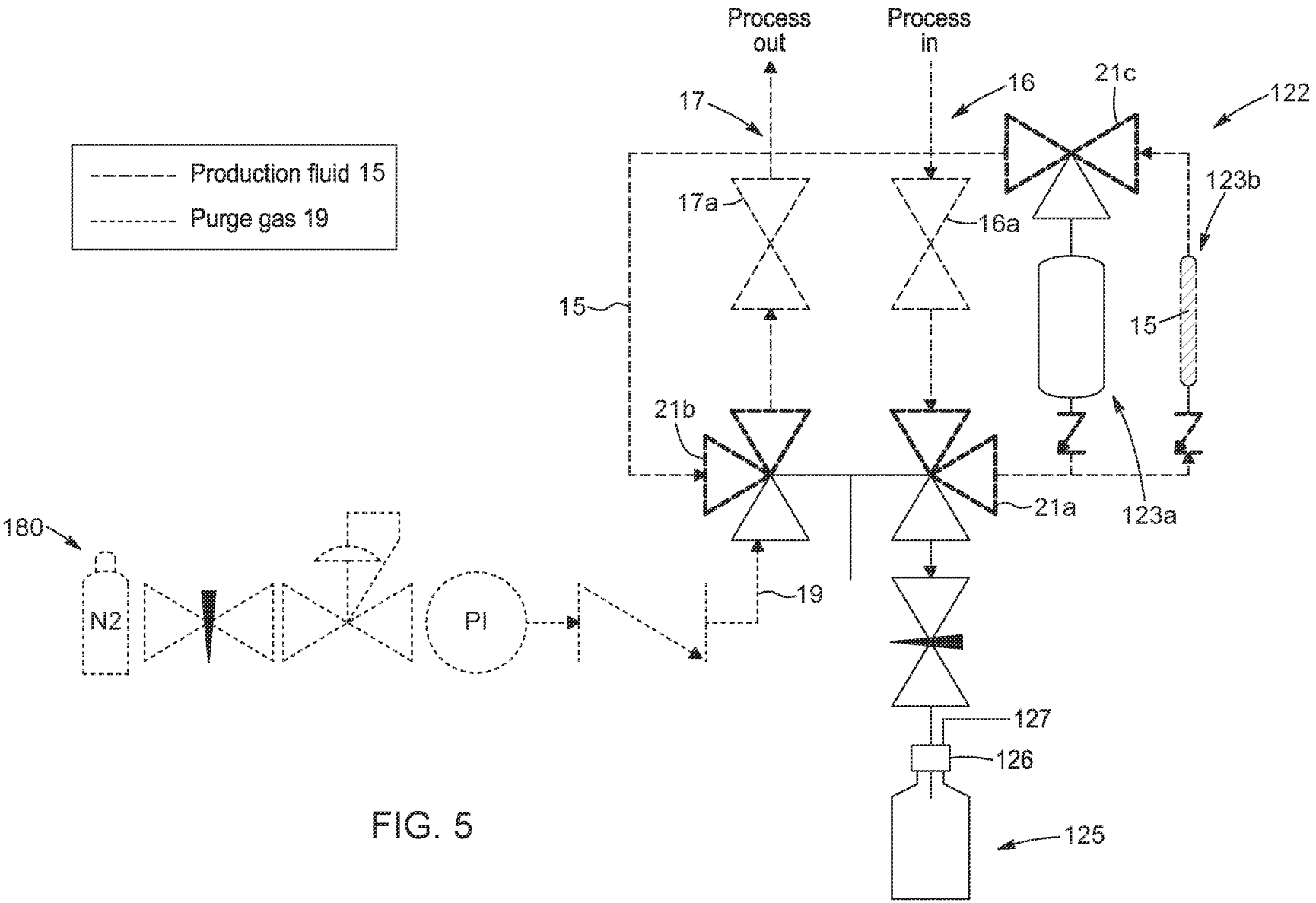
FIG. 5 is a schematic flow diagram for a fluid collector, illustrating a first step.
Figure 6:
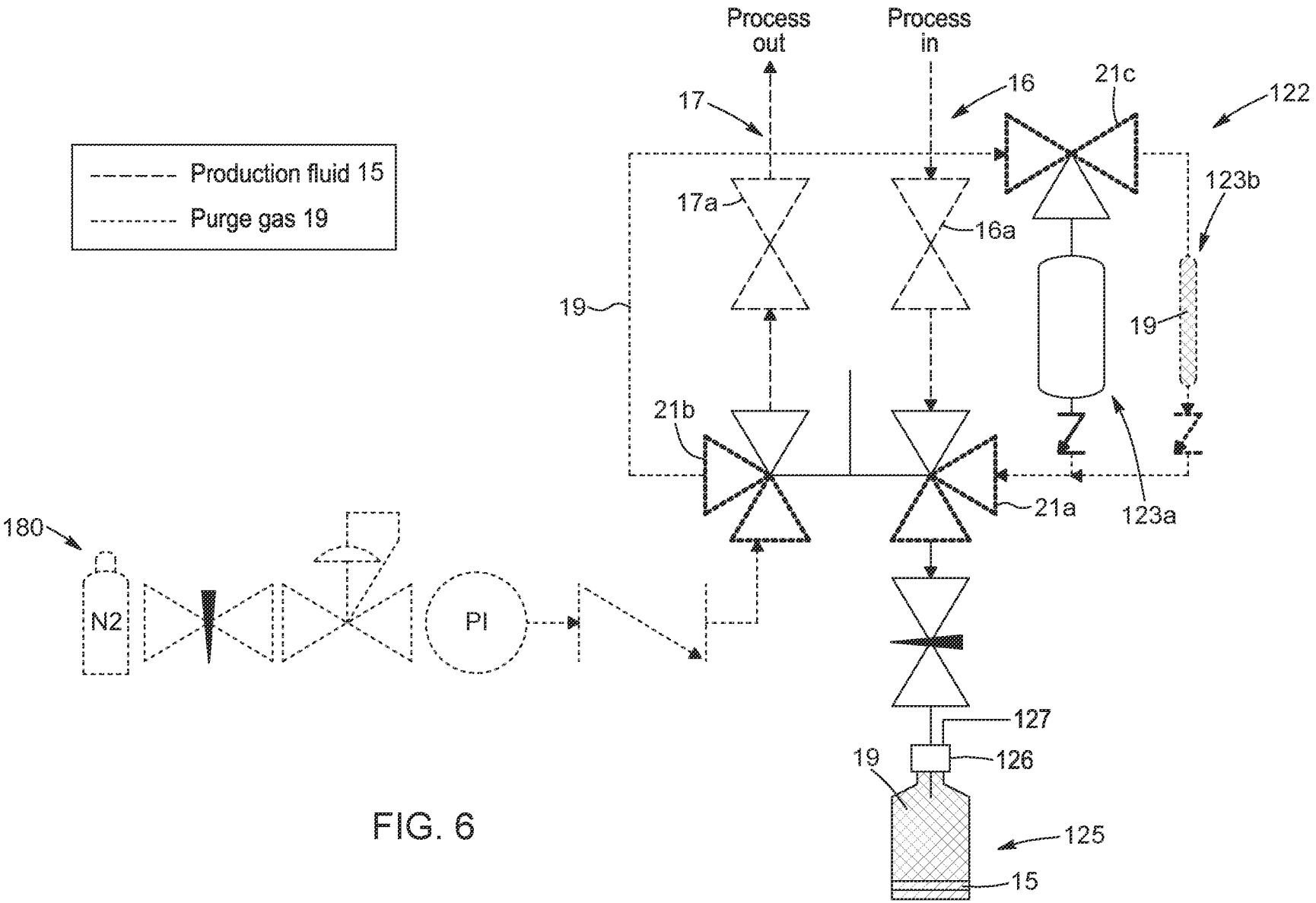
FIG. 6 is a schematic flow diagram for the fluid collector of FIG. 5, illustrating a second step.

FIGS. 5 and 6 illustrate a process flow for collecting a sample of production fluid using a fluid collector with two fixed-volume sampling cylinders. In this embodiment, the accumulator further includes a third 3-way valve 21*c* provides fluid communication between the second 3-way valve 21*b*, a first cylinder 123*a*, and a second cylinder 123*b*.

As shown in FIG. 5, the third 3-way valve 21*c* provides fluid communication between the second cylinder 123*b* and the second 3-way valve 21*b*, which is open to the sample return line 17, such that the production fluid 15 is bypassing the first fixed volume cylinder 123*a* and is flowing through the second fixed volume cylinder 123*b*. During this first stage, the second 3-way valve 21*b* is closed at the pressure vessel 180.

As shown in FIG. 6, the first 3-way valve 21*a* provides fluid communication between the second cylinder 123*b* and the sample container 125 and the second 3-way valve 21*b* provides fluid communication between the third 3-way valve

21*c*, which is open to the second cylinder 123*b*, and the pressure vessel 180, such that the purge gas 19 has displaced the production fluid 15 from the second cylinder 123*b* into the sample container 125. In the illustrated example, the second cylinder 123*b* has a smaller volume than cylinder 123*a*.

Providing two or more fixed volume cylinders having varying volumes may facilitate the taking of samples of a preferred volume. For example, it is contemplated that the system 100 can include a first cylinder having a volume of 100 mL and a second cylinder having a volume of 50 mL, such that a first sample collection schedule includes collecting 100 mL samples and a second sample collection schedule includes collecting 50 mL samples. It is understood that the fluid collector 120 can include any number of 3-way valves coupled to multiple cylinders in order to provide multiple collection amount options when determining second or subsequent collection schedules. In some embodiments, the first and second or subsequent collection schedules can be provided with the same or different time intervals and/or the same or different volumes of samples being collected.

It will be appreciated that alternative designs of fluid collectors may be used in one or more alternative embodiments, such as those available from Sampling Systems of Sweeny, Texas.

The cabinet 110 can house at least the fluid collector 120. Optionally, a stand may be provided with the cabinet 110 to provide support to all the components of the fluid collector 120. The stand preferably allows for height adjustment of the cabinet 110 to keep it level with the production flow line 14. In some embodiments, the cabinet 110 may be thermally insulated, cooled, and/or heated. In some embodiments, the cabinet 110 can be thermally insulated to maintain the temperature of the production fluid 15 as the production fluid 15 is continuously flowing through the cabinet 110 when a sample is not being taken. In some embodiments, the sampling system 100 can be integrated with other units at the wellbore 12 surface, such as to benefit from heat and/or fluid recycling. For example, in a steam assisted recovery process, the low-grade heat from steam generation can be introduced into the cabinet 110 as a heating source.

In some embodiments, the fluid collector 120 may be pneumatically actuated, and the cabinet 110 may be free of electronics. Such an arrangement may be characterized as having an improved safety profile, as the risk of electrical sparking in a potentially fume-rich environment may be negligible.

Referring back to FIG. 2, a schematic of a system 100 including a multi-day sampler that was used during a field trial conducted in the Oswego formation is shown. During the trial, approximately three (3) months of water tracer data was collected relating the tracing of two toe stages. As can be seen, the system 100 includes a sample line inlet line 16 providing fluid communication of the production fluid 15 from the production flow line 14 at the wellbore 12 into the cabinet 100 and a sample return line 17 providing fluid communication of the production fluid 15 from the cabinet back to the production flow line 14. The system 100 further includes a cabinet 115 containing the electronics (not shown). In this embodiment, a solar charging system 174 provides power to the electronics in the cabinet 115.

Referring back to FIG. 1, the system 100 also includes a controller 130. The controller 130 includes at least one computer processor and a memory. For example, the controller 130 may include one or more programmable logic controllers (PLCs). The controller 130 may be used to control operation of the fluid collector 120, collect and/or process sensor data, and/or communicate with a computing device 200. In some embodiments, the computing device is located remote from the wellbore 12 via a communications module 140.

The communications module 140 allows controller 130 and/or other electronics at the well site to communicate with the computing device 200. The communications module 140 may include a cellular transceiver, or other suitable wireless transmission equipment. In some embodiments, the controller 130 and the computing device 200 may be configured according to a supervisory control and data acquisition (SCADA) architecture. For example, the computing device 200 may include an API server module. SCADA systems, such as those available from WellCaddie™ of Edmond, Oklahoma, may be used in one or more embodiments.

In the illustrated example, the system 100 also includes a global positioning system (GPS) module 150, for determining a location of a component of the system, such as the cabinet 110. Location data from the GPS 150 may be used to monitor a location of the cabinet. For example, the GPS 150 can establish a 'geofence' around the expected location of the cabinet 110 and the controller 130 can trigger an alert if the cabinet 110 is moved without authorization.

In the illustrated example, the system 100 also includes a user interface 160, to allow an operator to interact with the PLC 130, the communications module 140, the fluid collector 120, and/or other systems or components present at the well site. An operator may use the user interface 160 when retrieving and/or loading the sample containers 125, and/or when initiating a new sample collection schedule.

For example, when an operator visits the well site, they may remove any filled sample containers 125, and load new sample containers into the carousel 128. They may also manually reset the controller 130, and/or initiate a sample collection schedule. For example, the operator may instruct the controller 130 to direct the fluid collector 120 to collect a sample every 24 hours.

In the illustrated example, the system 100 also includes a power module 170 for providing electrical power to the on-site equipment. As reliable power may not always be available at the well site, the power module 170 may include one or more rechargeable batteries or fuel cells 172, and a solar charging system 174. For example, solar charging system 174 may include one or more adjustable shatterproof 12.0 Vdc solar panels. Providing a power module 170 that includes one or more rechargeable batteries and an 'off grid' charging system may facilitate remote operations and the flexibility of placement anywhere on field locations, without relying on customer supplied AC power.

In the illustrated example, the system 100 also includes one or more sensors connected to a sensor module 190 for collecting data regarding the status, operation, and/or environment of the system 100. For example, the sensor module 190 may be configured to collect and/or monitor data related to a pressure of the sample inlet line 16, a flow rate of the production fluid 15, a pressure of the purge gas for the pressure vessel 180, position data for the carousel 128, location data via GPS 150, and/or signal strength for communications module 140.

As illustrated schematically in FIG. 1, the controller 130, the communications module 140, the GPS 150, the user interface 160, and/or the power module 170 (with the exception of solar panel(s) 174) may be provided within a housing or cabinet 115 that is separate from the cabinet 110.

The cabinet 115 is preferably compliant with the National Electrical Manufacturers Association (NEMA) IP66 standard (or higher).

Figure 7:
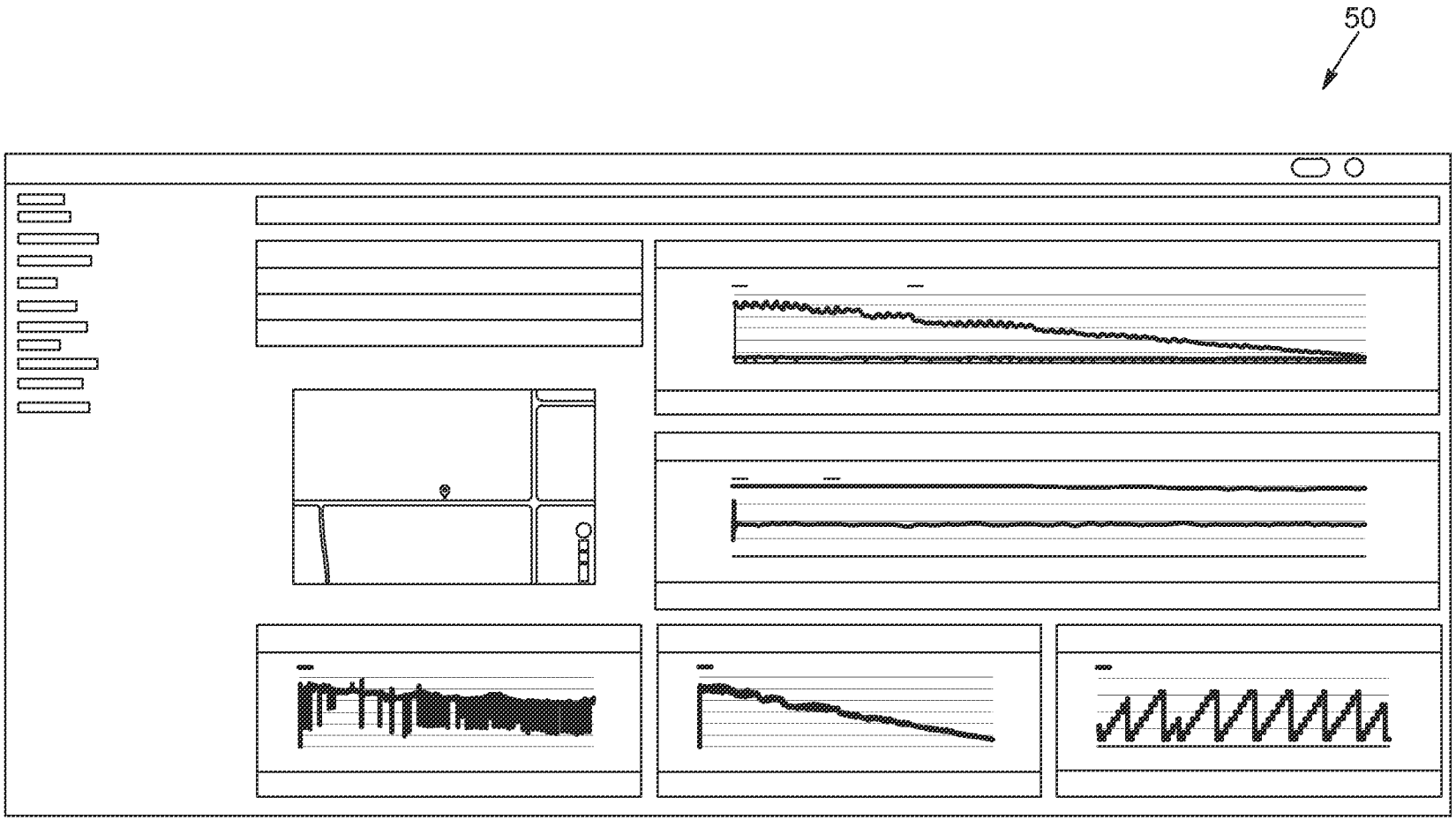
FIG. 7 is an example of a graphical user interface for a computing device located remote from the wellbore, in accordance with one embodiment.

FIG. 7 illustrates an example of a user interface 50 for display on a computing device 200 located remote from the wellbore. Such an interface 50 may allow data collected via the sensor module 190 to be monitored in real time or near-real time (e.g., data may be obtained approximately every 15 minutes). In some embodiments, the interface may be configured to display, monitor, and/or set alerts relating to:

a. the pressure and/or quantity of the purge gas 19 in pressure vessel 180;
b. a drop in well pressure (e.g., sampling may be deferred until well pressure returns to a predetermined threshold);
c. the number of unfilled sample bottles remaining in carousel 128;
d. the location of the GPS module 150 (e.g., geofencing);
e. the remaining charge and/or health of the rechargeable batteries/fuel cells 172;
f. a slug flow (e.g., sampling may be deferred until well pressure drops);
g. signal strength for the communications module 140;
h. leak detection due to fitting failure (e.g., by measuring a reduction in pressure in the pressure vessel 180 over time that exceeds the average sampling consumption reduction in pressure over the same amount of time, and/or by detecting sudden large reductions in pressure in the pressure vessel 180 indicative of leaks and/or ruptures); and/or
i. measuring usage (e.g., by measuring the average sampling consumption of purge gas, such as an inert gas, to predict the correct size of bottle to use. This may, for example, assist in purge gas canister fleet management, right sizing of purge gas bottles (i.e., pressure vessel 180), and/or detecting anomalies in solenoid operation (due to e.g., seal leaks, in situ temperature impact on inert gas consumption, etc.).

Figure 8:
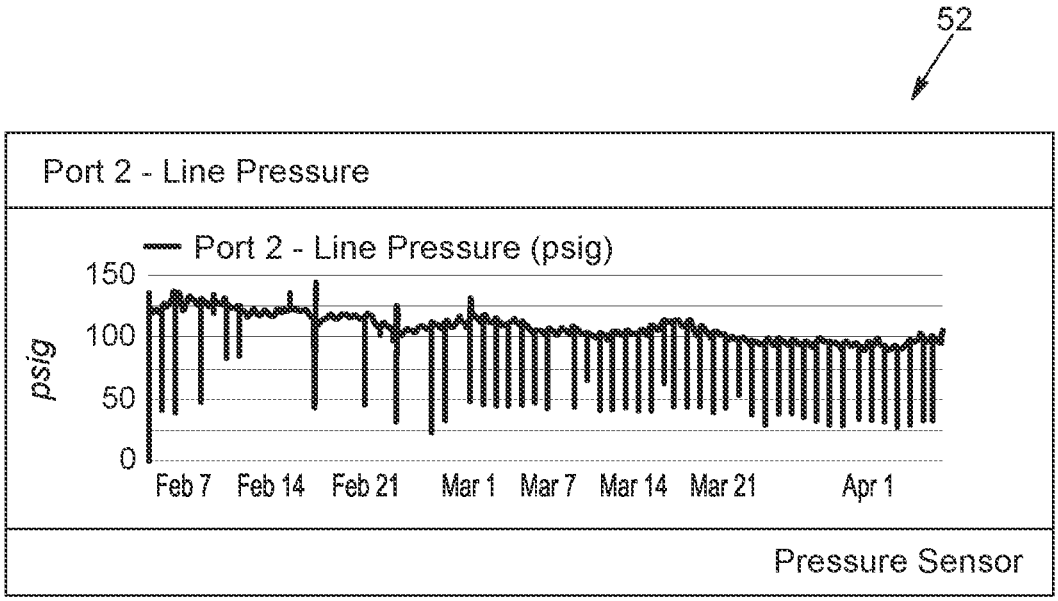
FIG. 8 is an enlarged portion of the graphical user interface of FIG. 7, illustrating data associated with line pressure.

FIG. 8 illustrates an example of a display of data 52 relating to the pressure in the sample inlet line 16. In some embodiments, this data may be used to identify significant decreases or increases in the well pressure.

Figure 9:
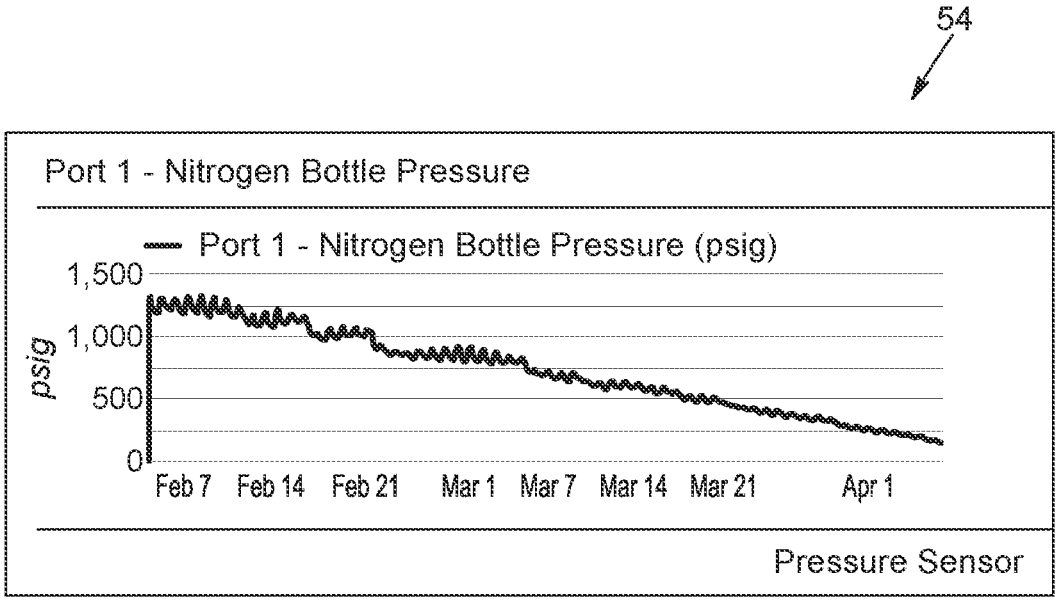
FIG. 9 is an enlarged portion of the graphical user interface of FIG. 7, illustrating data associated with a gas vessel pressure.

FIG. 9 illustrates an example of a display of data relating to the pressure in the purge gas vessel (i.e., the pressure vessel 180). In some embodiments, this data may be used to determine a replacement and/or refill schedule for the pressure vessel 180.

Figure 10:
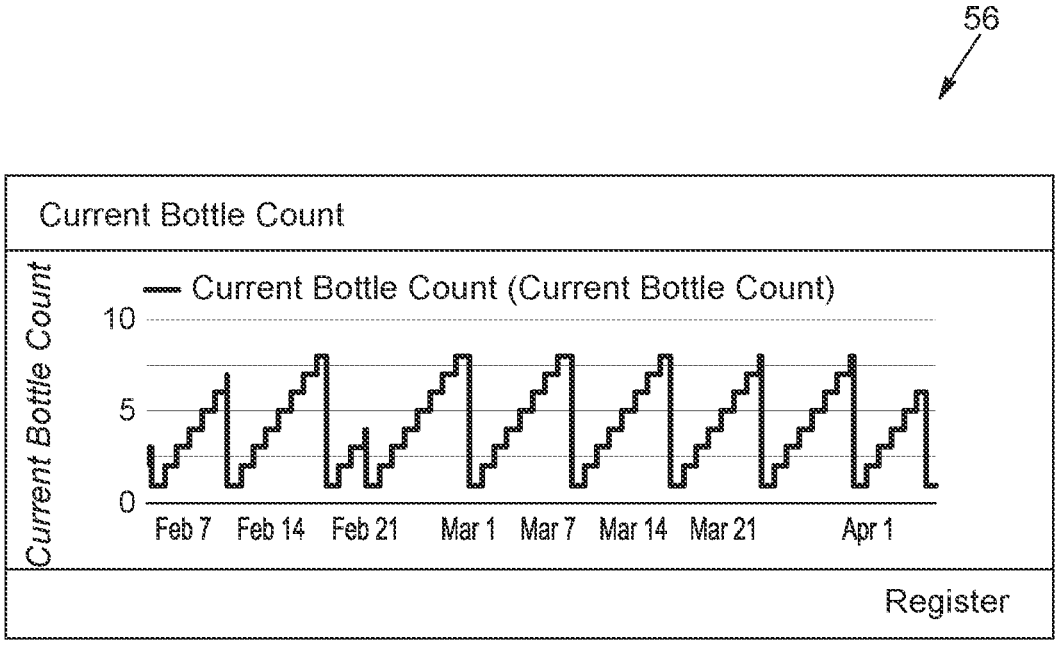
FIG. 10 is an enlarged portion of the graphical user interface of FIG. 7, illustrating data associated with a count of sample containers.

FIG. 10 illustrates an example of a display of data relating to the number of available (e.g., unfilled) sample containers 125 in the fluid collector 120. In some embodiments, this data may be used to determine a retrieval schedule to reduce or minimize operator visits to the well site.

Figure 11:
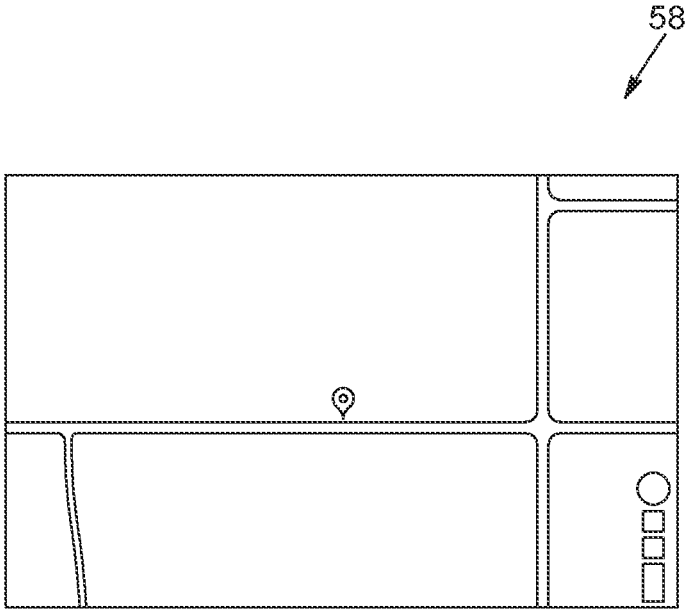
FIG. 11 is an enlarged portion of the graphical user interface of FIG. 7, illustrating data associated with a location of the sample collecting system.

FIG. 11 illustrates an example of a display of data relating to the location of the fluid collector 120. In some embodiments, this data may be used to ensure the equipment is not relocated without authorization.

Figure 12:
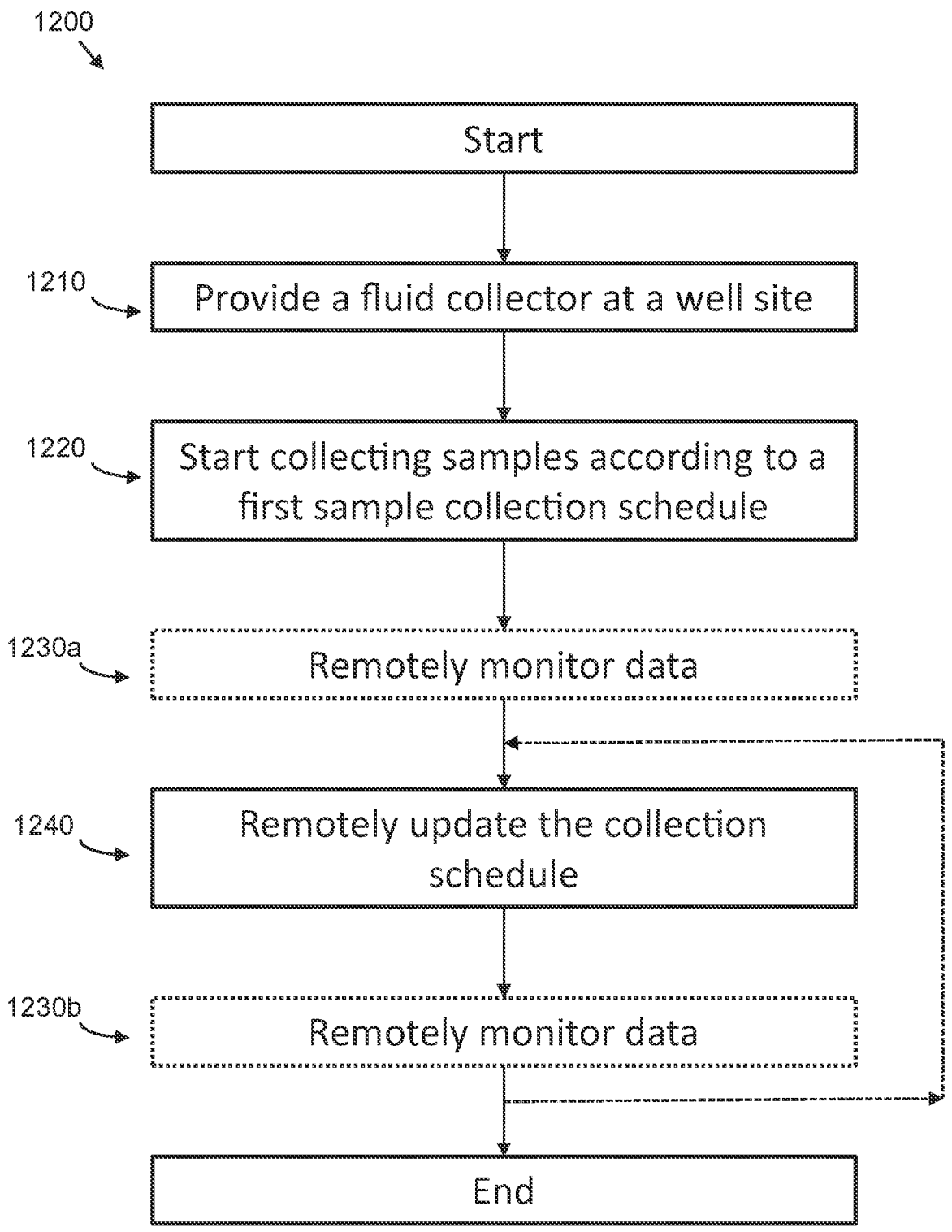
FIG. 12 is a flow diagram for an example method for collecting samples of production fluid from a wellbore.

Referring to FIG. 12, there is illustrated a method 1200 for collecting samples of production fluid from a wellbore. The method 1200 may be performed using the system 100, or another suitable apparatus.

At step 1210, a fluid collector, such as fluid collector 120, is provided at a well site. For example, the cabinet 110 and the cabinet 115 (and the equipment contained therein) may be connected to a production flow line 14 proximate a wellhead 12.

At step 1220, the fluid collector 120 is instructed to collect samples of production fluid 15 according to a first sample collection schedule. For example, control module 130 may reference a timer to determine if a predetermined time interval has expired (for example, the timer may be used to determine the length of an interval since a sample of production fluid 15 was last collected) and instruct the fluid collector 120 to collect a sample at the expiry of the timer. For example, control module 130 may instruct the fluid collector 120 to collect a sample of 100 mL of production fluid 15 in a new sample container 125 every 24 hours. According to such a schedule, if a sample carousel 128 is loaded with eight sample containers 125, the collection schedule will be finished in eight days, and an operator will need to attend the site to retrieve the collected samples before further sampling can take place.

At 1230*a*, data transmitted to a computing device 200, optionally located remote from the wellbore, is monitored and/or logged. For example, data regarding: the pressure at the sample inlet line 16, the flow rate of the production fluid 15, the pressure of the purge gas (i.e., pressure in the pressure vessel 180), position data for carousel 128, and/or GPS 150 location data, etc. may be monitored at a location remote from the well site.

At step 1240, the fluid collector 120 is instructed to collect samples of production fluid 15 according to a modified sample collection schedule (i.e., a collection schedule that is different than the first sample collection schedule initiated at 1220). In some embodiments, the modified sample collection schedule can have a different time schedule and/or a different volume of the production fluid 15 being collected. Alternatively, the modified sample collection schedule can include a ceasing of the fluid collector 120 collecting samples of the production fluid 15. In some embodiments, the fluid collector 120 can be automatically instructed to collect samples of production fluid 15 by the controller 130. For example, sampling may be remotely and/or automatically 'paused', or sampling frequency may be decreased to extend sampling until an operator can get out to the site location to retrieve and replace sample bottles (e.g., based on travel needs or weather).

As another example, one or more samples may be taken automatically and/or the sample collection schedule can be changed automatically in response to the data sensed by the one or more sensors. In some embodiments, the sample collection schedule can be automatically adjusted by the controller 130 when a change in the flow rate and/or the pressure of the production flow line 14 is determined. For example, in response to determining that pressure has increased or decreased by a predetermined amount or percentage, the fluid collector 120 may be instructed to collect a sample outside of the sample collection schedule or to stop collecting samples. As another example, in response to determining that the flow rate has increased or decreased by a predetermined amount or percentage, the fluid collector 120 may be instructed to collect a sample outside of the sample collection schedule or to stop collecting samples. In some embodiments, the predetermined amount or percentage can be about 5% and about 25%, and preferably about 10% of the average pressure and/or flow rate.

As another example, the sample collection schedule may be automatically modified or modified based on an instruction from the operator based on other parameters. For example, the sample collection schedule may be modified after a tracer is injected on a well pad proximate the well site (e.g., as in a waterflood operation) to improve or maximize efficiency in sampling based on an expected tracer flow.

At step 1230*b*, the data transmitted to the computing device 200 is monitored and/or logged. The data monitored at 1230*b* may be the same or different than the data monitored at 1230*a*.

Optionally, step 1240 may be repeated (i.e., the sample collection schedule may be modified) any number of times, or until all of the sample containers 125 in the carousel 128 are full.

Providing a system in which a sample collection schedule can be modified from a remote location—and/or performing a method in which a sample collection schedule can be modified from a remote location—may have one or more advantages.

For example, the number and/or frequency of site visits by an operator may be reduced or minimized. By remotely monitoring e.g., the number of unfilled sample containers, the pressure remaining in the purge gas storage vessel (i.e., pressure vessel 180), etc., an operator may only be dispatched when there is a need to retrieve sample containers and/or refill/replace the purge gas vessel (pressure vessel 180). This may reduce a required number of operators to retrieve samples and/or otherwise reduce operational expenditures.

Additionally, or alternatively, a sample collection schedule may be updated responsive to monitored data, instead of simply following a timer. For example, a first collection schedule may include taking a 100 mL sample once every 24 hours. The collection schedule may be remotely updated to include taking a ~8 mL sample every 2 hours (i.e., 12 times/day) into a single sample container 125, and then advancing the carousel 128 to the next unfilled container.

For example, with reference to FIGS. 5 and 6, according to a first collection schedule, the control module 130 may instruct fluid collector 120 to collect a sample of production fluid using the fixed-volume first cylinder 123*a* in a new sample container 125 every 24 hours. According to a second collection schedule, the control module 130 may instruct fluid collector 120 to collect a sample of production fluid using the fixed-volume second cylinder 123*b* every 2 hours.

Additionally, or alternatively, a sample collection schedule may be updated responsive to the availability of operators to attend the site and retrieve samples. For example, a first collection schedule may include taking a 100 mL sample once every 24 hours for 8 days. If it is projected that an operator will not be available to attend the site to retrieve collected samples (e.g., due to adverse weather, staffing levels, etc.) for an extended period, the collection schedule may be remotely updated to include taking a 100 mL sample e.g. once every 48 hours, which may allow the collection of samples for 16 days. For example, it may be considered preferable to have samples from every 48 hours for 16 days instead of samples from every day for 8 days, and 8 days with no sampling.

In some embodiments, the method for collecting samples is implemented at a wellsite that located on land and used for oil and/or gas recovery in the production phase. The wellsite can include one or more wells that may be separate or extend from a common well pad. Alternatively, the method for collecting samples can be implemented at offshore wellsite facilities. The well can be a production well that is part of an in situ hydrocarbon recovery operation that can include various techniques, such as fracturing; fluid injection such as steam huff-and-puff (also known as cyclic steam stimulation, CSS) or flooding with water, steam or another fluid; acidification; enhanced oil recovery methods; and so on. It is also possible to implement the method during phases other than the conventional production phase of the well, such as during pre-treatment, start-up, wind-down, or another phase where sampling of fluid drawn up from the well can occur. The wells can have various features in terms of orientations, patterns and completions (e.g., having a vertical, horizontal or slanted orientation; being open hole, lined, cased, perforated; and being part of a horizontal well pair or vertical well flooding pattern). The sampling system can be integrated into the surface facilities of the wellsite that includes various other units for separation, monitoring and processing of production fluid and optionally injection fluid.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A method for collecting samples of production fluid from a wellbore, the method comprising:

providing a fluid collector configured to selectively divert the production fluid from a production flow line downstream of the wellbore to at least one of a plurality of sample containers on a carousel, and a controller comprising a processor, a memory, and a communication module configured to communicate with a computing device located remote from the fluid collector;

instructing the fluid collector to divert multiple samples of the production fluid to at least one of the sample containers according to a first sample collection schedule;

during the first sample collection schedule, instructing the fluid collector, via the computing device located remote from the fluid collector, to divert multiple samples of the production fluid to at least another one of the sample containers on the carousel, and changing the first sample collection schedule to a second sample collection schedule, the second sample collection schedule being different than the first collection schedule; and collecting the sample containers from the carousel for analysis.

2. The method of claim 1, further comprising:

monitoring one or more sensors to collect data associated with at least one of: a location of the fluid collector; a pressure of the production fluid; a flow rate of the production fluid; a pressure of a pneumatic actuation system associated with the fluid collector; an ambient temperature; and a level of a power supply configured to supply electrical power to the controller; and transmitting at least a portion of the collected data to the computing device located remote from the fluid collector.

3. The method of claim 2, wherein the monitoring is performed at least every 60 minutes, at least every 30 minutes, or at least every 15 minutes.

4. The method of claim 2, wherein the second sample collection schedule is determined in response to at least the portion of the collected data transmitted to the computing device located remote from the fluid collector.

5. The method of claim 2, wherein the collected data comprises data associated with the pressure of the production fluid, and wherein in response to determining that the pressure of the production fluid has increased or decreased by a predetermined percentage, the fluid collector is instructed to divert samples of the production fluid to the another one of the sample containers according to the second sample collection schedule and within a predetermined time of determining the increase or decrease in production fluid pressure.

6. The method of claim 5, wherein the predetermined percentage is between about 5% and about 25%.

7. The method of claim 5, wherein the predetermined time is between about 2 minutes and about 30 minutes.

8. The method of claim 2, wherein the collected data comprises data associated with the flow rate of the production fluid, and wherein in response to determining that the flow rate of the production fluid has increased or decreased by a predetermined percentage, the fluid collector is instructed to divert samples of the production fluid to the another one of the sample containers according to the second sample collection schedule within a predetermined time of determining the increase or decrease in production fluid flow rate.

9. The method of claim 8, wherein the predetermined percentage is between about 5% and about 25%.

10. The method of claim 8, wherein the predetermined time is between about 2 minutes and about 30 minutes.

11. The method of claim 1, wherein the first sample collection schedule comprises diverting samples of production fluid to the at least one sample container more frequently than the second sample collection schedule.

12. The method of claim 1, wherein the first sample collection schedule comprises diverting a first volume of production fluid to the at least one sample container and the second sample collection schedule comprises diverting a second volume of production fluid to the at least one sample container.

13. The method of claim 12, wherein the first volume is greater than the second volume.

14. The method of claim 1, further comprising, after instructing the fluid collector to divert multiple samples of production fluid to the at least one sample container according to the second sample collection schedule:

instructing the fluid collector, via the computing device located remote from the fluid collector, to divert multiple samples of production fluid to the at least one sample container according to a third sample collection schedule, the third sample collection schedule being different than the second collection schedule.

15. The method of claim 1, wherein instructing the fluid collector to divert multiple samples of production fluid to the at least one of the sample containers according to the first sample collection schedule is performed at the fluid collector.

16. A method of collecting samples of production fluid from a wellbore, the method comprising:

providing a fluid collector configured to selectively divert the production fluid from a production flow line downstream of the wellbore to at least one of a plurality of sample containers on a carousel, and a controller comprising a processor, a memory, and a communication module configured to communicate with a computing device;

instructing the fluid collector to divert multiple samples of the production fluid to the at least one of the sample containers according to a first sample collection schedule;

monitoring one or more sensors to collect data associated with at least one of: a location of the fluid collector; a pressure of the production fluid; a flow rate of the production fluid; a pressure of a pneumatic actuation system associated with the fluid collector; an ambient temperature; and a level of a power supply configured to supply electrical power to the controller;

transmitting at least a portion of the collected data to the computing device, wherein the controller is configured to change the first sample collection schedule in response to the data transmitted and divert a sample of the production fluid to another one of the sample containers on the carousel upon changing the first sample collection schedule; and collecting the sample containers from the carousel for analysis.

17. The method of claim 16, wherein the collected data comprises data associated with the pressure of the production fluid, and wherein:

in response to determining that the pressure of the production fluid has increased or decreased by a predetermined percentage, the controller is configured to change the first sample collection schedule to a second sample collection schedule, and the second sample collection schedule comprises diverting the sample of production fluid to the another one of the sample containers within a predetermined time of determining the increase or decrease in production fluid pressure.

18. The method of claim 16, wherein the collected data comprises data associated with the flow rate of the production fluid, and wherein;

in response to determining that the flow rate of the production fluid has increased or decreased by a predetermined percentage, the controller is configured to change the first sample schedule to a second sample collection schedule, and the second sample collection schedule comprises diverting the sample of production fluid to the another one of the sample containers within a predetermined time of determining the increase or decrease in production fluid flow rate.

19. A method of collecting samples of production fluid from a wellbore, the method comprising:

providing a fluid collector configured to selectively divert the production fluid from a production flow line downstream of the wellbore to at least one of a plurality of sample containers on a carousel, and a controller comprising a processor, a memory, and a communication module configured to communicate with a computing device;

instructing the fluid collector to divert multiple samples of the production fluid to at least one of the sample containers according to a first sample collection schedule;

monitoring one or more sensors to collect data associated with at least one of: a location of the fluid collector; a pressure of the production fluid; a flow rate of the production fluid; a pressure of a pneumatic actuation system associated with the fluid collector; an ambient temperature; and a level of a power supply configured to supply electrical power to the controller;

instructing the fluid collector to divert multiple samples of the production fluid to another one of the sample containers on the carousel and changing the first sample collection schedule to a second sample collection schedule in response to the collected data; and collecting the sample containers from the carousel for analysis.

20. The method of claim 19, wherein monitoring the one or more sensors to collect data comprises collecting data associated with the pressure and/or the flow rate of the production fluid; and wherein instructing the fluid collector to divert the samples of the production fluid to the another one of the sample containers according to the second sample collection schedule is in response to determining that the pressure and/or the flow rate of the production fluid has increased or decreased by a predetermined percentage.

* * * * *